US006208302B1

(12) United States Patent
Jacob

(10) Patent No.: US 6,208,302 B1
(45) Date of Patent: Mar. 27, 2001

(54) MOBILE TELEPHONE ANTENNA SYSTEM FOR A SATELLITE AND MOBILE TELEPHONE INCLUDING THIS ANTENNA SYSTEM

(75) Inventor: Hervé Jacob, Le Mans (FR)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/483,921

(22) Filed: Jan. 18, 2000

(30) Foreign Application Priority Data

Jan. 19, 1999 (FR) ..... 99 00526

(51) Int. Cl.[7] ..... H01Q 1/24
(52) U.S. Cl. ..... 343/702; 343/850; 343/895
(58) Field of Search ..... 343/702, 850, 343/853, 858, 860, 895; H01Q 1/24, 1/36, 1/38

(56) References Cited

U.S. PATENT DOCUMENTS

| | | | | |
|---|---|---|---|---|
| 4,656,485 | | 4/1987 | Werner | 343/876 |
| 5,581,268 | * | 12/1996 | Hirshfield | 343/853 |
| 5,594,461 | | 1/1997 | O'Neill, Jr. | 343/895 |
| 5,872,549 | * | 2/1999 | Huynh et al. | 343/895 |
| 5,945,963 | * | 8/1999 | Leisten | 343/895 |
| 6,002,359 | * | 12/1999 | Chen | 343/895 |

FOREIGN PATENT DOCUMENTS

| | | | |
|---|---|---|---|
| 9735356A1 | 9/1997 | (WO) | H01Q/11/08 |
| 9828814A1 | 7/1998 | (WO) | H01Q/1/24 |

* cited by examiner

*Primary Examiner*—Tho Phan
(74) *Attorney, Agent, or Firm*—Jack D. Slobod

(57) ABSTRACT

An antenna system for a mobile telephone operates by radio channel between the mobile telephone (1) and at least one at a time of a group of satellites (2) revolving in polar orbit or quasi polar orbit around the earth. The antenna system includes a cone-shaped antenna (3) for transmission and reception with at least four equi-angularly spaced apart spiral strands. Radio frequency signal is fed to or from the strands at the apex or small diameter end of the cone with relative phases to selectively produce for circularly polarized radiation, in a first mode of operation (m1), an antenna pattern of substantially hemispherical form, and in a second mode of operation (m2), an antenna pattern of substantially toriodal form. A switch mode function (SWF) block (11) is controlled by a control block (16) to automatically effect selection of the mode of operation in accordance with a priori or a posteriori selection criteria. These criteria may be communication mode responsive, telephone orientation responsive, or test and connection responsive.

11 Claims, 3 Drawing Sheets

MOBILE TELEPHONE ANTENNA SYSTEM FOR A SATELLITE AND MOBILE TELEPHONE INCLUDING THIS ANTENNA SYSTEM

BACKGROUND OF THE INVENTION

1. Field of the Invention

The present invention relates to an antenna system for a cellular mobile telephone operating by radio channel between said mobile and a group of stations revolving in polar orbit or quasi polar orbit around the earth.

The invention also relates to a mobile telephone including such antenna system.

Within the framework of the diversification and extension of cellular mobile telephone networks, the number of base stations is continuously increasing in densely populated areas, which are on the way to being completely covered by the conventional networks of the main operators. The problem of coverage is nevertheless posed for other geographical areas. It is particularly important in desert areas or maritime regions.

The invention is more particularly adapted to new operators who propose to mitigate these flaws of conventional networks by proposing cellular systems that operate by radio channel between the mobile and a group of satellites revolving in polar orbit around the earth. The various projects differ in their state of progress, the precise frequency bands used of the order of 1 or 2 GHz, the numbers of satellites and their orbits, and in the status of the agency that provides the network. For these new networks and for this type of channels, mobile telephones are to be provided which also have new antennas and which antennas can no longer be reduced to a single strand, because the satellites (that is to say, the base stations) with which communication is effected, be this either in the calling mode or in the stand-by mode, may be several thousand kilometers apart in space.

2. Description of the Related Art

The concept and the choice of the antennas for such mobile telephones is particularly critical in the case of a network by satellite: the main reasons therefor are the distances between the base station and the mobile, the circular polarization required for the waves, the result of the gain/temperature ratio of noise on reception and the various positions the mobile may take up relative to the satellite as a function of the use of the former and the position of the latter. Moreover, the concept of the mechanical reference system does not exist in the mobile application: any definition of a polarization angle is illusive, because the user adjusts the telephone antenna to any angle that evolves when he moves and it would be impossible to impose a vertical or horizontal angle of polarization.

The receiving quality depends on the gain of the antenna, but also on the total of its radiation diagram that is to present low values in the noisy directions as regards radioelectricity, that is to say, the directions, in essence, towards the ground. The quality criterion currently used is furthermore the ratio between the antenna gain in the direction of the received waves and the total temperature of received noise, that is, G/T.

For the application to mobile telephony, the antenna is to optimize this criterion as much as possible during the communication phases, during which phases the user holds his telephone in an approximately upright position, without excessively degrading this criterion during the stand-by phases, in order to permit sufficient operation for making contact with a user who has put his mobile on a flat horizontal support. When in communication, the solid angle to be covered is 2 Π steradians along the main axis of the telephone, above the horizontal plane. Conversely, when the mobile is put down again, the interesting angle for receiving signals coming from a satellite close to the perigee is perpendicular to its main axis. that is, to the side of the telephone, which corresponds to the horizon if the mobile is put back in its normal (upright) position and the gain is thus to have a certain value in this direction.

An antenna in the form of a conical spiraled antenna with various strands is chosen as a circularly polarized antenna, intended for the implementation of the invention. Such an antenna is known per se from U.S. Pat. No. 4,656,485. In this case, it is an antenna that is fixed to the ground, designed for transmitting and receiving short waves at frequencies of the order of several MHz. It may function in two switching modes via a supply reversal of 2 of its 4 strands so as to obtain omnidirectional radiation diagrams with larger or smaller angles of elevation and, besides, with different frequencies depending on the mode of excitation.

OBJECTS AND SUMMARY OF THE INVENTION

It is an object of the invention to provide an assembly of a mobile telephone and an antenna firmly attached to each other, communicating with a group of satellites, which assembly can function in a nominal manner during the communication phases and in an acceptable manner during the stand-by phases.

It is a further object of the invention to provide an assembly of a mobile telephone and an antenna firmly attached to each other, communicating with a group of satellites, which assembly can operate in a nominal manner in an upright position and in an acceptable manner in horizontal position.

According to the invention, these objects are achieved and the constraints cited above are satisfied thanks to the fact that the antenna system for a cellular mobile telephone indicated in the first paragraph is characterized in that the antenna, being circularly polarized in the form of a conical spiral antenna having various strands, comprises in its base station Switch Mode Function means (SMF means) joined to said mobile telephone, the switching automatically being effected according to certain selection criterions, between two possible modes of operation, while said criterions are posed a priori or a posteriori.

The dimensions of the antenna described here are adapted to the frequencies of the signals to be processed and are counted in centimeters, in contrast to the fixed antenna of cited United States patent, which is supported by a vertical mast several meters high.

Preferably, the antenna of the antenna system according to the invention comprises 4 strands angularly spaced Π/2 apart according to a rotation around the axis of a supporting conical shaft fixed by its large base or small diameter end to the upper end of the telephone handset, and each strand comprises coaxial cables as its supply means, of which cables for each cable one end of the core is connected via a first end to the end of the strand located at the small base or large diameter end of said conical shaft, and the other end to said SMF means.

Preferably, the antenna system comprises phase shifter means controlled by the SMF means for feeding the strands with radio frequency signals phase shifted by Π/2 between adjacent strands in a first mode of operation and phase shifted by Π between adjacent strands in a second mode of operation; these phase shifters are, for example, 0–180° and 0–90° hybrid couplers.

A preferred embodiment of the invention is characterized in that said SMF means further include for a switching based on an a priori selection criterion, mercury drop switches for realizing said first mode of operation for the bidirectional link with a satellite, when the antenna with the telephone that supports it is extended in an essentially vertical position, and for realizing said second mode of operation that consists of a stand-by phase, so as to maintain a link with a satellite for an essentially horizontal position.

For the first mode of operation, the radiation diagram of the antenna is almost spherical, directed to the top of the antenna and is quite favorable for a vertical position of the antenna, whereas the transmission in the direction of the earth is weak or nearly zero for the 2Π lower steradians. For the second mode of operation, the diagram obtained has, in contrast, the form of a torus whose axis is that of the antenna, which guarantees radiation being partly directed upwards for any horizontal position. In vertical position, the radiation diagram is in the second mode of operation to be favored still for angles of elevation that are comparatively small, but not for angles of elevation that approach Π/2.

Another preferred embodiment of the invention is characterized in that said SMF means further include, for a switching based on an a posteriori selection criterion, periodic test means of said first and said second mode of operation, and means for connecting said phase shifter means ensuring the selection of the better of the 2 tested modes of operation.

According to the latter embodiment it is no longer both the position of the telephone that controls one or the other connection of the antenna and the angular position of the satellite with which the telephone is communicating.

In order not to be cumbersome and to be compatible with a reduced-size telephone itself, it is preferred to utilize as an antenna a high-permittivity dielectric support for supporting the radiating strands. With this object, the antenna is realized, for example, by means of a ceramic truncate cone on which said strands are deposited in accordance with hybrid circuit technology and which has along its axis a hole through which the coaxial cables pass for feeding the strands.

BRIEF DESCRIPTION OF THE DRAWING

These and other aspects of the invention are apparent from and will be elucidated, by way of non-limitative example, with reference to the embodiment(s) described hereinafter.

In the drawing.

DETAILED DESCRIPTION OF THE PREFERRED EMBODIMENTS

Figure 1:
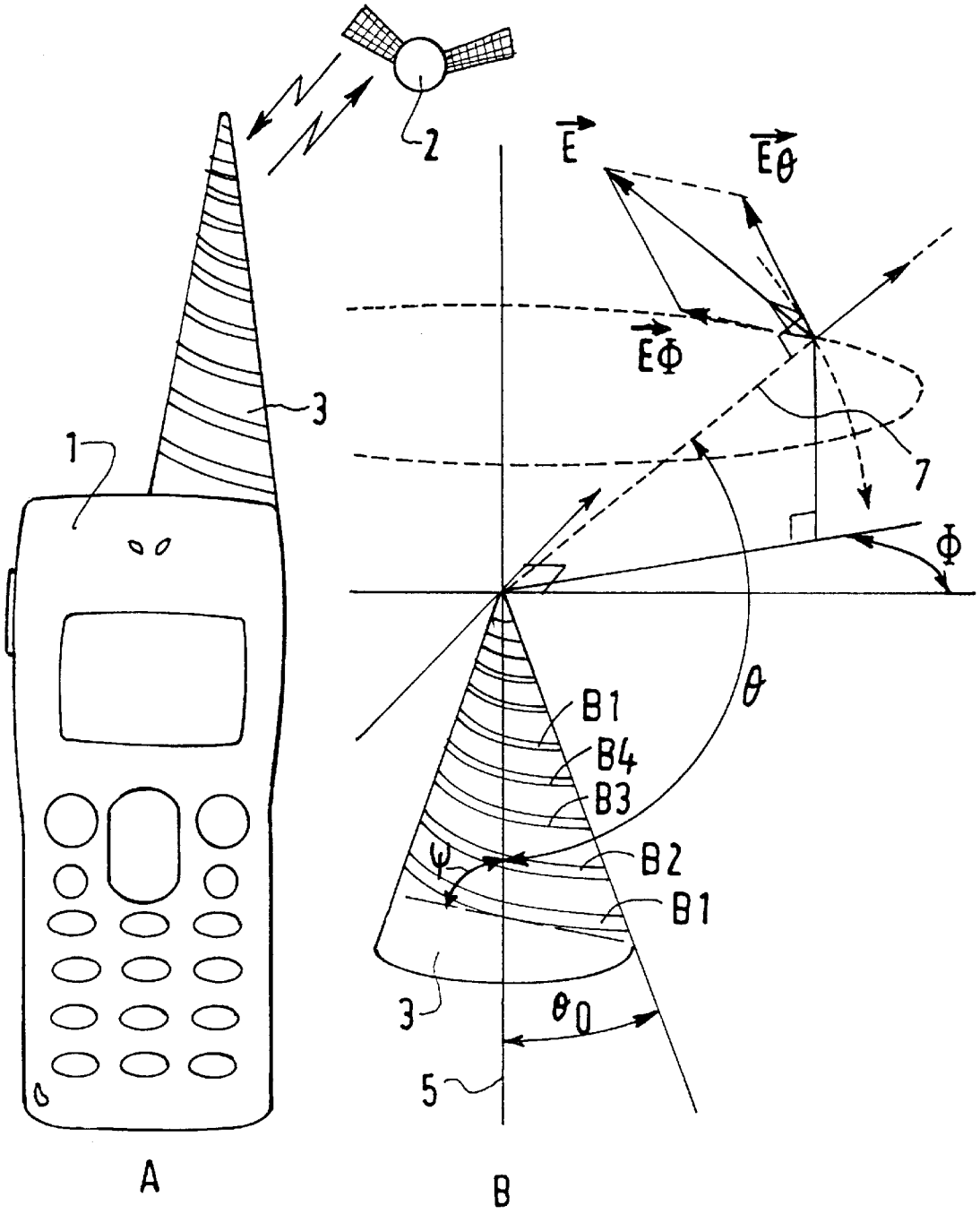
FIG. 1A represents a mobile telephone including its antenna system according to the invention.
FIG. 1B represents a conical spiral antenna used in the antenna system according to the invention.

The mobile telephone 1 represented in FIG. 1A is a cellular telephone designed for communicating by radio channel with a group of satellites such as 2, the satellites making a polar or quasi polar orbit around the earth; for this purpose, the mobile telephone includes a conical spiral antenna with various strands 3. The satellite with which the telephone is communicating at a given instant is found at a distance that is of the order of one thousand or several thousand kilometers away and it may take an arbitrary angle of elevation, that is to say, between 0 and Π/2. The main constraint governing this type of communication is that the G/T ratio between the antenna gain in the direction of the received waves and the total temperature of received noise is optimized most during the communication phases in which the user uses his telephone in an approximately upright position, without excessively degrading this criterion during the stand-by phases, so that a user who has put his mobile on a horizontal supporting plane can sufficiently make contact. For this reason, the antenna 3 comprises 4 interleaved strands B1, B2, B3, B4 (FIG. 1B), fed at the point of the support cone, this point being in practice the small base of a truncate cone, referenced 4 in FIG. 2, and the separate feeding of these 4 strands may be realized in two different ways as described below.

FIG. 1B shows the electric field $\vec{E}$ generated by the antenna 3. This antenna has the particularity that the geometrical form of the radiating strands is identically repeated when the dimensions are multiplied by a constant factor K. In contrast, this similarity realizes a rotation relative to the vertical axis 5 that depends on the rate K and on the angle ψ of the winding of the spiral that forms the radiating strands. This property enables to realize wideband operating-frequency antennas, because the form of the antenna is as it were the same for all frequencies; the currents inside the strands are propagated from the point of excitation at the open or small diameter end of the cone to the base by progressively being attenuated as soon as the power is radiated. The winding of the strands augments their length for a given volume, which enables to diminish the band of operation towards the low frequencies; towards the high frequencies only the precision with which strands are realized at the top of the cone forms the theoretical limit; the polarization of the emitted wave along the axis is a circular polarization, which results from the symmetry of the phases of the radiating strands associated to their mechanical symmetry of rotation with respect to the axis of the antenna. The direction of the circular polarization depends on the direction of the winding of the spiral. In practice, the antenna of FIG. 1 is designed for operation in the band lying between 0.8 and 2 GHz; it is characterized, among other things, by the definition of the following angles:

ψ angle of winding of the spirals

Θ compound angle of elevation (angle of elevation increased by Π/2)

ϕ angle of azimuth.

The symmetry along the main axis 5 guarantees an omnidirectional azimuth radiation, that is, a constant amplitude of the electric field $\vec{E}$ as a function of the angle ϕ. On the other hand, the elevation radiation is directive and the amplitude of the field $\vec{E}$ is a function of the angle Θ: moreover, this variation law depends on the relative phase of the supply signals of the various strands. The polarization is elliptical: one polar component $\vec{E}\phi$ of the field is orthogonal to the axis 5 and to the vector radius 7, and another radial component $\vec{E}\Theta$ of the field is orthogonal to the vector radius, but in the plane formed by the vector radius and the axis 5.

Figure 2:
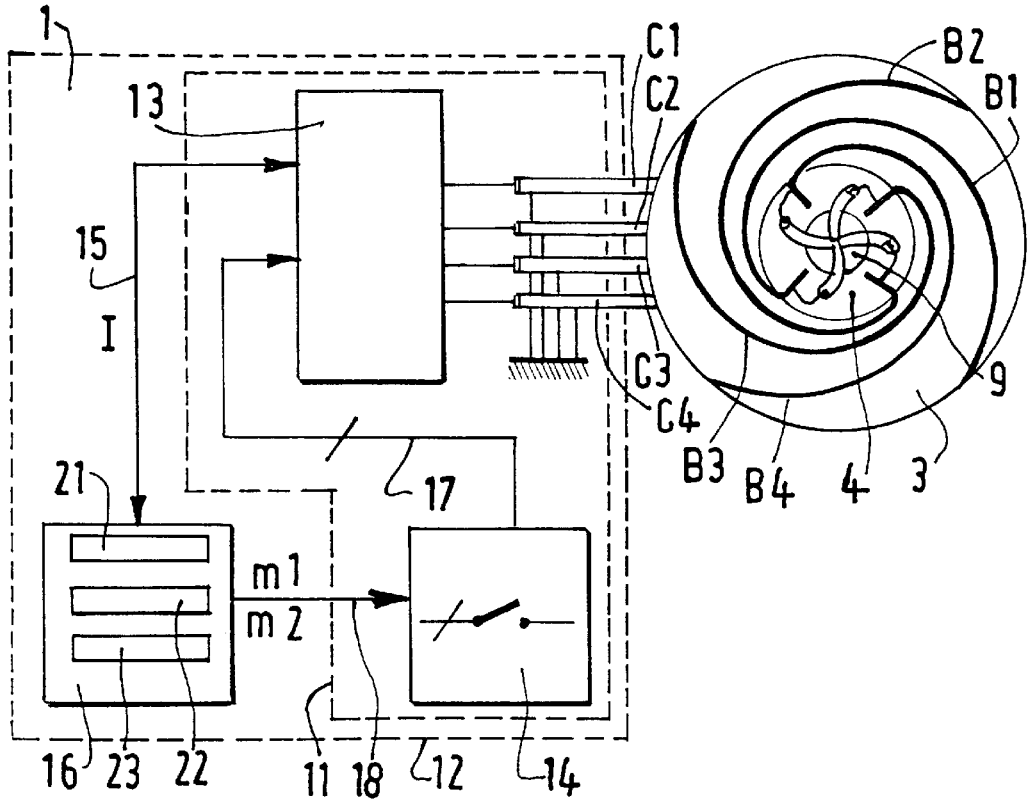
FIG. 2 is a block diagram of the antenna system according to the invention.

FIG. 2 enables to explain the basic principle of the invention. In this Figure, the antenna 3 is represented seen from above and in a stylized form to render it understandable and not to overload the drawing. The Figure comprises, along its axis (5 in FIG. 1B), a central hole 9 for passing the 4 coaxial cables C1, C2, C3, C4 through for feeding the strands B1 to B4. The core of these coaxial cables is connected on one side to the end of the strands located on the small base 4 of the truncate cone and, on the opposite side, to Switch Mode Function means (SMF means) contained within the dashed-line perimeter 11, whereas the perimeter 12 surrounds the mobile telephone 1 that supports the antenna 3. It will be noted that the gains of the coaxial cables are connected to the ground of the cellular mobile telephone as represented in the Figure. The SMF means are symbolized by two blocks, phase shifter means 13 and switching means 14. A bidirectional link 15 connects the phase shifter means 13 to the block 16 that symbolizes the rest of the electronics of the apparatus; this link 15 carries the signal I received or transmitted by the antenna 3. In the middle of the SMF means, a link 17 having various conductors symbolizes that the switching means 14 control the phase shifter means, so as to be able to realize either of the 2 possible phase shifter configurations between carrier strands of the signal 1, which 2 configurations will be described hereinafter. The switch itself is controlled by controller 16 by a conductor 18 that has the logic 1 state and the logic 0 state, these two states involving either mode of operation of the antenna 3.

The 2 radiation diagrams sought for implementing the invention result from the 2 modes of excitation of the 4-strand or 2 dipole antenna by calling the signal I applied to the respective strands B1 to B4 I1, I2, I3, I4 as indicated in the following Table:

TABLE I

| Mode | I1 | I2 | I3 | I4 | Phase function (I phase) |
|---|---|---|---|---|---|
| 1 | Π/2 | Π | −Π/2 | 0 | $e^{\pm j.3\phi}$ |
| 2 | −Π | 0 | Π | 0 | $e^{\pm j.2\phi}$ |

Figure 3:
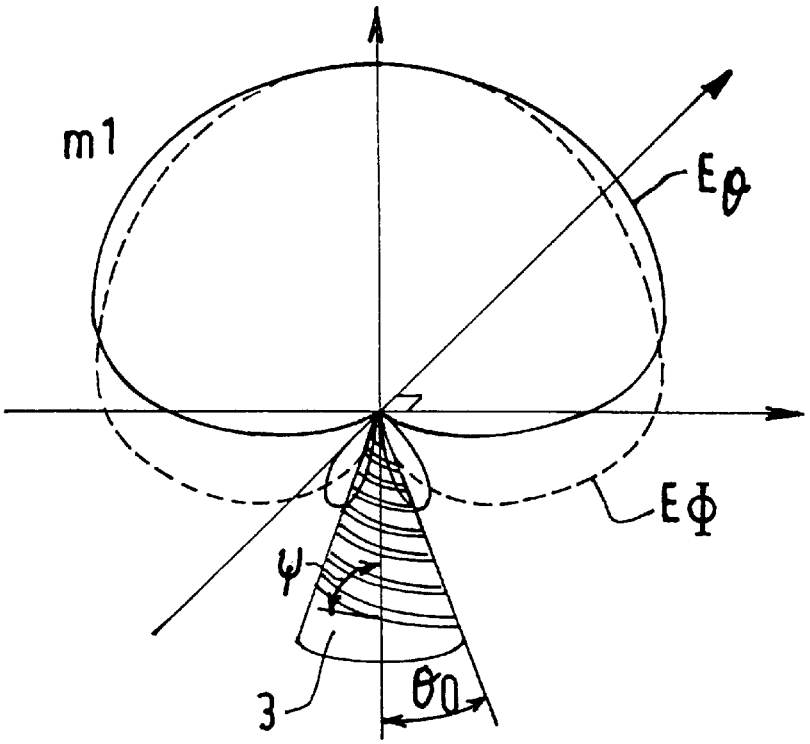
FIGS. 3 and 4 represent in a cross-sectional view the radiating diagrams obtained according to the first and the second mode of operation of the antenna system, respectively.

The radiation diagram that results from the mode 1 (m1) is represented in FIG. 3 where the mode 1 (m1) is drawn in a dashed line EΦ, which is the maximum modulus of the component $\vec{E}\phi$, and as a solid line EΘ, which is the maximum modulus of $\vec{E}\Theta$ (at the spot where the curves converge, the polarization is circular, and elliptical in the other directions). This diagram of substantially hemispherical form may be slightly modified as a function of the characteristics: spiral angle and width of the strands. According to this first mode, the current circulates from the point (of the small base) at the top of the cone to the large base, but the radiation takes place in the opposite direction, for which the currents in the various parts of the strands are added together with the same phase, that is, in the direction pointed at by the top of the cone. This diagram covers in an acceptable manner the upper hemisphere preferably for the communication phases, whereas in the directions that point towards the earth from which noise comes in essence, the amplitude of the fields $\vec{E}\Theta$ and $\vec{E}\phi$ is low. These fields are sinusoidal at high frequency and are phase shifted with time in quadrature, which is at the origin of the circular polarization when the moduli of the two components are the same, and slightly elliptical when they are different.

Figure 4:
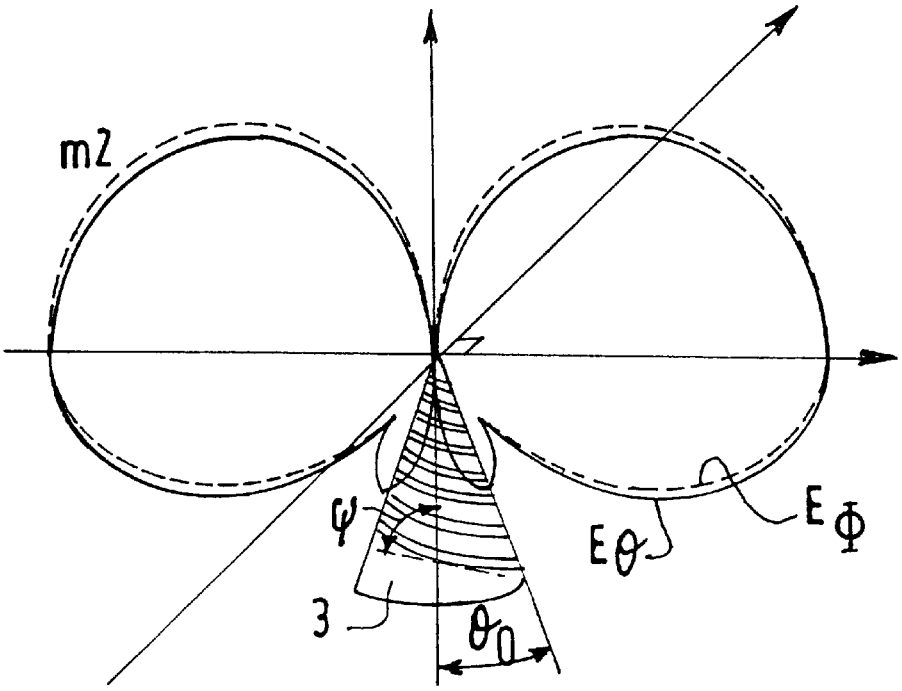

The second radiation diagram that results from the mode 2 (m2) is represented in FIG. 4. It corresponds to phase shifts of Π radii between a radiating strand and its adjacent strand. This type of diagram of substantially toroidal form is suitable for the second functionality required from the antenna, that is, the coverage along the edges to ensure a priori the radio channel with the satellite for the calling phases of the mobile by a remote user, preferably with the mobile in horizontal position.

Various selection criterions of the radiation mode may be maintained, while these criterions are posed a priori or a posteriori.

If the criterion posed a priori consists of saying that the mobile is in an upright position during a communication, and in a horizontal position when in the stand-by mode, a simple means consists of the fact that when the mobile is put in the communication mode, it activates the mode 1 (m1) in an authoritarian way and that the end of the communication activates the mode 2 (m2). The communication mode responsive selection means necessary for performing this function, which is within the scope of the expert, are symbolized by the block 21 inside the block 16, FIG. 2.

Still according to the same a priori criterion, but permitting changes of mode during the conversation or stand-by phase, the mobile telephone may comprise an angle detector that detects the fact that the telephone is laid down in horizontal position. This detector may be a simple mercury drop switch that provides the one or the other possible binary state on the conductor 18 (FIG. 2). These orientation responsive selection means are symbolized by the block 22, FIG. 2. The switching means 14 select the mode 2 when the telephone is laid down in horizontal position. In contrast, the switching means select the mode 1 when the angle detector sends out the information, indicating the vertical position of the mobile; whether it is a communication phase or a stand-by phase.

The receiving quality information in terms of bit error rates of the received digital transmission may be used for optimizing the mode switching. The circuits are then more complex; but the best reception mode of the antenna is chosen whatever the electrical environment in the channel. For example, in intermediate situations such as a satellite going down to the horizon again, or the mobile held in oblique position, a return to the mode m1 position may be favorable for optimizing the G/T ratio on reception. This is an a posteriori criterion of choice and, for using it, test means are to be used of the first (m1) and second (m2) mode of operation and connection mode of the phase shifter means (13), which ensures the selection via switching means 14 of the better of the 2 tested modes of operation, after each test phase. These test responsive selection means are symbolized by the block 23, FIG. 2. It will be noted that the telephone 1 may comprise one of the selection means 21, 22 or 23 or two of them or the three of them. In the latter case, authoritative selection means are to be provided to select one of these means with the exclusion of the other(s).

Figure 5:
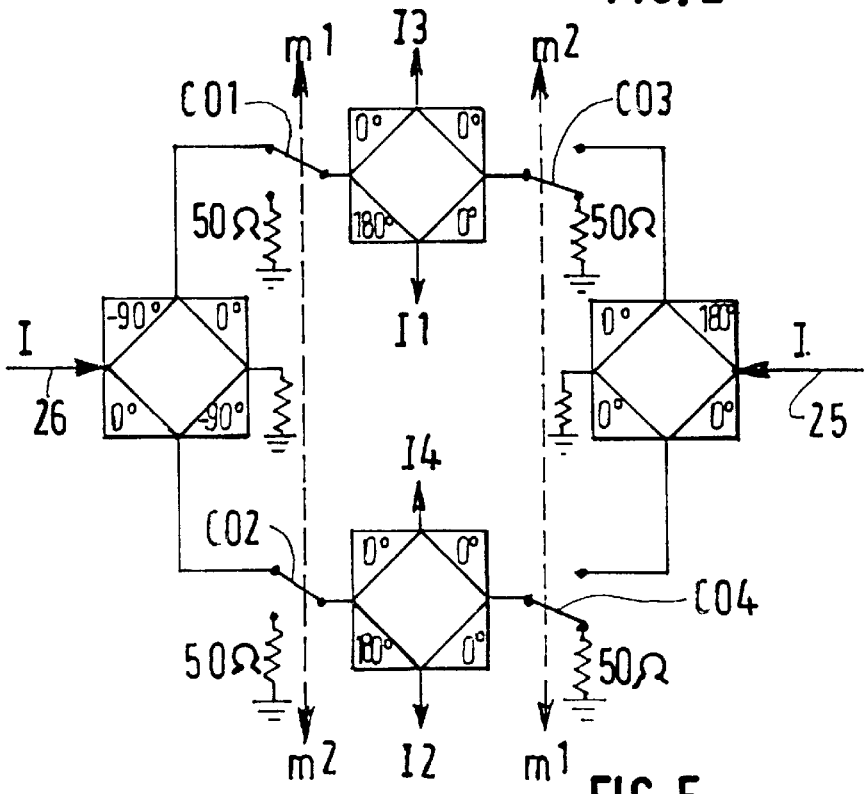
FIG. 5 shows an example of embodiment for the switching means for the operation modes for the antenna system according to the invention.

FIG. 5 shows by way of example a coupling and supply device for the radiating strands, with an input 26 reserved for the mode m1 and an input 25 reserved for the mode m2 for the high-frequency signal I. As the case may be, it is phase shifter means realized on the basis of 0–180° and 0–90° hybrid couplers. The 4 two-position switches CO1, CO2, CO3, CO4 inside this device connect 50 Ω loads to the isolated accesses of the couplers. It is to be observed that these resistors do not normally dissipate any energy when the couplers are well balanced, but are nevertheless necessary for a proper operation of the couplers.

In FIG. 5, the position of the switches CO1 to CO4 is such that it is the operation mode m1 that is selected; in their reverse position this would be the mode m2.

It will be noted that other realizations of the coupling device bringing about the same phase correction functions as the device of FIG. 5 are possible, notably with a switchable delay via delay lines; 0°/180° coupling of two opposite strands by transformers, . . .

On the mechanical level, the realization of the antenna 3 (FIGS. 1 and 2) is to maintain the properties of symmetry of the radiating elements relative to the axis 5 of the conical structure, which generally imposes feeding lines of the radiating dipoles centered on this axis in the least costly realization. The dimensions of such an antenna may be of the order of 10 cm in height for a frequency of the order of 2 GHz, which gives an approximately 16 cm length of a radiating strand for a cone angle $2\Theta_o$ equal to 20°, and a coil winding angle ψ of 50° which corresponds to 2.11 times the wavelength for the dipole formed by 2 opposite strands.

For a maximum miniaturization, these dimensions may be reduced in various manners:

In the first place, while using a dielectric support having a high permittivity for supporting the radiating strands. A material that is very suitable for this purpose is ceramic and in this case the strands are applied to the (truncate) cone according to hybrid circuit technology.

One may also charge the ends of the radiating strands via resistors. The effect of this is that the passband is extended towards the low frequencies in terms of antenna impedance, but at the cost of the efficiency in this part of the passband, since the resistors then dissipate the energy supplied to the antenna, which is not radiated. This solution may nevertheless be interesting for antennas having two frequencies, for example, 0.9 GHz/2 GHz.

Finally, another reduction of the volume of the antenna may be considered a possibility when one of the diameters of the circular base of the cone is reduced, which would then become elliptical; the elliptical ratio would then have to be determined as a function of the admissible degradation of the omnidirectionality of the azimuth radiation diagram as a function of the angle ϕ.

What is claimed is:

1. An antenna system for a mobile telephone for operating via a radio channel between said mobile telephone and at least one of a group of stations revolving in non-geosynchronous orbit around the earth, said antenna system comprising a conical antenna having an even number of at least four spiral strands angularly spaced apart by an equi-angular spacing according to a rotation around the axis of a supporting conical body having a large diameter end and an apex or small diameter end, said supporting conical body being adapted to be fixed by its large diameter end to an upper end of a mobile telephone, and switch mode function (SMF) means including phase shifter means for selectively feeding radio frequency signals to or from said strands via one end of said conical body which, in a first mode of operation, are phase shifted between each pair of adjacent strands by said equi-angular spacing and, in a second mode of operation, are phase-shifted by Π between each pair of adjacent strands, and control means for automatically controlling the SWF means to effect selection between the first and second modes of operation according to an a priori or a posteriori selection criterion.

2. The antenna system as claimed in claim 1, wherein the antenna comprises 4 strands angularly spaced Π/2 apart according to a rotation around the axis of a supporting conical shaft and the radio frequency signals are fed to or from said strands by said SWF means at the apex or small diameter end of said conical body.

3. The antenna system as claimed in claim 2, wherein the supporting conical body is a ceramic truncate cone on which said strands are deposited and which has along its axis a hole through which coaxial cables pass for feeding radio frequency signals to or from the strands at the apex or small diameter end of the supporting conical body.

4. The antenna system as claimed in claim 2 intended to operate in a frequency range lying between 800 MHz and 2 GHz, wherein the antenna is formed by a ceramic truncate cone of the order of 10 cm in height, having a cone angle $2\Theta_o$, and the strands having a winding angle ψ, to result in the strands being of the order of 16 cm in length.

5. A mobile telephone for operating by radio channel with at least one of a group of satellites revolving in polar orbit or quasi polar orbit around the earth, said mobile telephone comprising the antenna system as claimed in claim 2, wherein the conical supporting body is fixed by its large diameter end to an upper end of the mobile telephone, and said coaxial cables feeding said strands have jackets which are connected to a ground of the mobile telephone.

6. The antenna system as claimed in claim 1, wherein said phase shifter means is formed by 0–180° and 0–90° hybrid couplers.

7. The antenna system as claimed in claim 1, wherein said control means includes for effecting selection of the mode of operation based on an a priori selection criterion, detection means for detecting whether the mobile telephone is in a first or a second communication state, the control means effecting the first or second mode of operation in dependence on whether it is detected that the mobile station is in the first communication state or the second communication state.

8. The antenna system as claimed in claim 1, wherein said control means includes, for effecting selection of the mode of operation based on an a priori selection criterion, an orientation sensor for effecting said first mode of operation when the antenna is in an essentially upright orientation, and for effecting said second mode of operation when the antenna is in an essentially horizontal orientation.

9. The antenna system as claimed in claim 1, wherein said control means further includes, for effecting selection of the mode of operation based on an a posteriori selection criterion, periodic test means of said first and said second mode of operation, and means for connecting said phase shifter means ensuring the selection of the better of the two tested modes of operation.

10. An antenna system as claimed in claim 1, wherein the radio frequency signals are fed to or from the strands at the apex or small diameter end of said conical body.

11. An antenna system for a mobile telephone for operating via a radio channel between said mobile telephone and at least one of a group of stations revolving in non-geosynchronous orbit around the earth, said antenna system comprising a conical antenna having a plurality of spiral strands angularly spaced apart according to a rotation around the axis of a supporting conical body having a large diameter end and an apex or small diameter end, said supporting conical body being adapted to be fixed by its large diameter end to an upper end of a mobile telephone, and switch mode function (SMF) means including phase shifter means for selectively feeding radio frequency signals to or from said strands via one end of said conical body having relative phases to produce for circularly polarized radiation, in a first mode of operation, an antenna pattern having a substantially hemispherical form and, in a second mode of operation, an antenna pattern having a substantially toroidal form, and control means for automatically controlling the SWF means to effect selection between the first and second modes of operation, said control means including an orientation sensor for effecting said first mode of operation when the antenna is in an essentially upright orientation, and for effecting said second mode of operation when the antenna is in an essentially horizontal orientation.

* * * * *